US009859623B2

(12) United States Patent
Bosshard et al.

(10) Patent No.: US 9,859,623 B2
(45) Date of Patent: Jan. 2, 2018

(54) STRUCTURAL ANTENNA MODULE INCORPORATING ELEMENTARY RADIATING FEEDS WITH INDIVIDUAL ORIENTATION, RADIATING PANEL, RADIATING ARRAY AND MULTIBEAM ANTENNA COMPRISING AT LEAST ONE SUCH MODULE

(71) Applicant: THALES, Courbevoie (FR)

(72) Inventors: Pierre Bosshard, Tournefeuille (FR); Nicolas Ferrando, Tournefeuille (FR); Jean-Christophe Lafond, Toulouse (FR)

(73) Assignee: THALES, Courbevoie (FR)

( * ) Notice: Subject to any disclaimer, the term of this patent is extended or adjusted under 35 U.S.C. 154(b) by 2 days.

(21) Appl. No.: 15/099,393

(22) Filed: Apr. 14, 2016

(65) Prior Publication Data

US 2016/0315396 A1 Oct. 27, 2016

(30) Foreign Application Priority Data

Apr. 24, 2015 (FR) ..... 15 00870

(51) Int. Cl.

| | |
|---|---|
| ***H01Q 13/00*** | (2006.01) |
| ***H01Q 21/24*** | (2006.01) |
| ***H01Q 13/02*** | (2006.01) |
| ***H01Q 19/17*** | (2006.01) |
| ***H01Q 21/06*** | (2006.01) |
| ***H01Q 25/00*** | (2006.01) |

(52) U.S. Cl.
CPC ..... *H01Q 21/245* (2013.01); *H01Q 13/0258* (2013.01); *H01Q 19/17* (2013.01); *H01Q 21/064* (2013.01); *H01Q 25/007* (2013.01)

(58) Field of Classification Search
None
See application file for complete search history.

(56) References Cited

U.S. PATENT DOCUMENTS

| | | | | |
|---|---|---|---|---|
| 6,087,908 A * | 7/2000 | Haller | ..... | H01P 1/161 333/122 |
| 6,861,999 B2 * | 3/2005 | Suga | ..... | H01Q 1/247 343/756 |

FOREIGN PATENT DOCUMENTS

| | | | | |
|---|---|---|---|---|
| EP | 2 202 839 A1 | | 6/2010 | |
| JP | 562-203401 A | | 9/1987 | |
| JP | 2008-131575 | * | 6/2008 | ..... H01Q 19/17 |
| JP | 2008-131575 A | | 6/2008 | |

* cited by examiner

*Primary Examiner* — Trinh Dinh
(74) *Attorney, Agent, or Firm* — Baker & Hostetler LLP

(57) ABSTRACT

A radiating feed of a structural module comprises a feed horn linked to an RF system via a bent ring to orient the feed horn in a desired direction. The bend of the bent ring has an aperture angle of value predefined individually for each horn as a function of the desired orientation, and a vertex placed in a plane of symmetry of the RF system orthogonal to the plane XY containing the RF system. The RF systems of each radiating feed can then be arranged alongside one another and be incorporated in structural planar subassemblies, reducing the number of parts needed to create the multibeam antenna.

11 Claims, 6 Drawing Sheets

STRUCTURAL ANTENNA MODULE INCORPORATING ELEMENTARY RADIATING FEEDS WITH INDIVIDUAL ORIENTATION, RADIATING PANEL, RADIATING ARRAY AND MULTIBEAM ANTENNA COMPRISING AT LEAST ONE SUCH MODULE

CROSS-REFERENCE TO RELATED APPLICATION

This application claims priority to foreign French patent application No. 1500870, filed on Apr. 24, 2015, the disclosure of which is incorporated by reference in its entirety.

FIELD OF THE INVENTION

The present invention relates to a structural antenna module incorporating elementary radiating feeds with individual orientation, a radiating panel comprising a structural module, a radiating array comprising a number of radiating panels and a multibeam antenna comprising at least one structural module. It applies to the space field such as satellite telecommunications and, more particularly, to the multibeam antennas comprising an array of a number of radiating feeds placed in the focal plane of a reflector.

BACKGROUND

A radiating feed consists of a radiating element, for example a horn, connected to a radiofrequency (RF) system. The RF system comprises RF components making it possible to switch from a mode of guided propagation of the electromagnetic waves to a radiated mode and produces, for each beam, the functions of transmission and of reception in a particular frequency band, for example the Ka band. The transmission and reception functions can be performed in single-polarization mode to cover the needs of the users or in bi-polarization mode to ensure links to terrestrial gateway stations.

In the multibeam antenna architectures, a number of independent elementary radiating feeds are assembled in an array placed in the focal plane of a reflector. Assembling the different radiating feeds is complex because it often requires the radiating feeds to be maintained with a specific orientation making it possible to limit the phase aberrations linked to the defocusing of the horn in relation to the centre of the reflector and to maximize the performance levels of the antenna for each beam. Each radiating feed is assembled on a mechanical support by an interface specific to each horn. This individual assembly of each feed entails individually managing the interface of each RF system and the setting of the orientation of each horn, which does not make it possible to pool the production of the RF systems because their RF axes are not mutually parallel. The individual management of each feed therefore has a significant cost.

To facilitate the individual orientation of each radiating feed, as represented in FIG. 1, it is known practice to individually fix the radiating feeds onto a structural plate 13 in which distribution waveguides 14 are machined that are intended to route RF signals between the radiating feed and input/output ports of an RF signal processing device. The distribution waveguides are connected to outputs of the RF systems 10 by flexible waveguides 15 making it possible to individually orient each radiating feed. The structural plate 13 then ensures the routing of the distribution waveguides 14 as well as the support and orientation of the RF systems relative to the reflector of the multibeam antenna. However, this solution requires the RF systems to be assembled independently of one another, an individual orientation of each RF system and of the associated horn, and entails the use of numerous flexible orientation waveguides inducing additional ohmic losses and additional thermal power to be dissipated. Furthermore, this solution is possible only when the feeds of the focal array are sufficiently spaced apart from one another to allow the routing of the distribution waveguides between the RF systems supported by the structural plate.

To our knowledge, there is currently no structural antenna module comprising a set of radiating feeds whose RF systems are completely incorporated in a common support, and that allow individual orientation of the feed horns.

SUMMARY OF THE INVENTION

A first aim of the invention is remedy the drawbacks of the known radiating feed arrays, and to produce a structural antenna module in which the RF axes of the RF systems of all the radiating feeds are arranged in a same plane and in which the orientation of the feed horns is ensured without modifying the orientation of the RF system axes.

A second aim of the invention is to produce a structural antenna module comprising a number of radiating feeds incorporated in a one-piece assembly.

For that, the invention relates to a structural antenna module incorporating elementary radiating feeds, each radiating feed comprising a radiofrequency system linked to a feed horn. The RF system comprises a main waveguide having a longitudinal axis arranged at right angles to a plane XY, an orthomodal transducer OMT comprising two mutually orthogonal transverse branches, situated parallel to the plane XY and coupled at right angles to the main waveguide by respective coupling slots. The feed horn is coupled to a terminal end of the main waveguide via a bent orientation ring intended to orient the feed horn in a desired direction different from the longitudinal axis of the main waveguide, the bend of the orientation ring being placed in a plane of symmetry of the RF system, the plane of symmetry being orthogonal to the plane XY and containing the bisecting line of the angle formed by the two transverse branches.

Advantageously, the structural module can further comprise a support plate common to all the radiating feeds, the RF systems being completely incorporated in the support plate.

Advantageously, the orientation ring associated with each feed horn can be housed in a dedicated aperture formed in a front face of the support plate. Alternatively, the terminal end of the main waveguide of each RF system can be housed in a dedicated aperture formed in a front face of the support plate and the orientation ring associated with each feed horn can be fixed onto a front face of the support plate, in the extension of the corresponding terminal end.

Advantageously, the orientation ring of each radiating feed can consist of three parts secured together, the three parts consisting of two rigid access waveguides having different longitudinal axes which are intended to be respectively linked to a feed horn and to an RF system, and a matching waveguide section located between the two access waveguides, the matching waveguide section forming the bend of the orientation ring.

Alternatively, the orientation ring can comprise a coupling iris.

The invention relates also to a radiating panel comprising a structural module.

Advantageously, the radiating feeds can be machined in a matrix in a common support plate and can comprise respective supply and output waveguides, routed in the common support plate and respectively linked to input and output ports grouped alongside one another on the radiating panel.

The invention relates also to a radiating array comprising at least one radiating panel.

Advantageously, the radiating array can comprise a number of radiating panels that can be oriented independently of one another.

The invention relates also to a multibeam antenna comprising at least one radiating array.

BRIEF DESCRIPTION OF THE DRAWINGS

Other particular features and advantages of the invention will become clearly apparent hereinafter in the description given by way of purely illustrative and nonlimiting example, with reference to the attached schematic drawings which represent.

DETAILED DESCRIPTION

Figure 1:
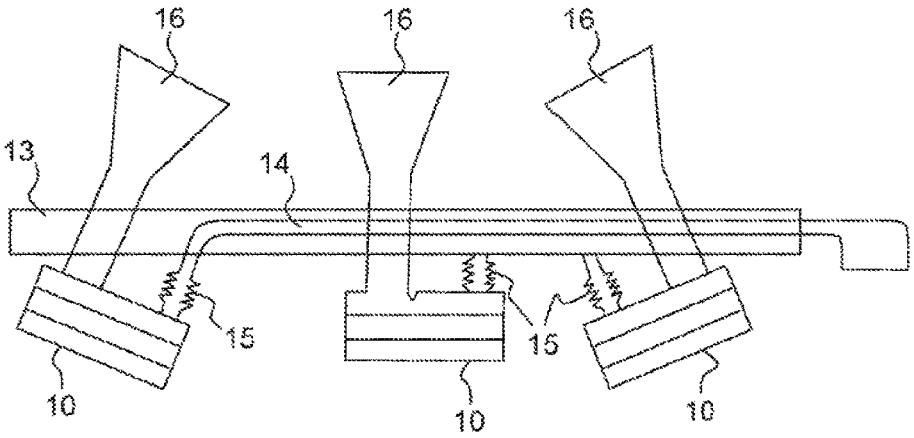
FIG.1 PRIOR ART
FIG. 1: a cross-sectional diagram of an exemplary array of radiating feeds, according to the prior art.
Figure 2:
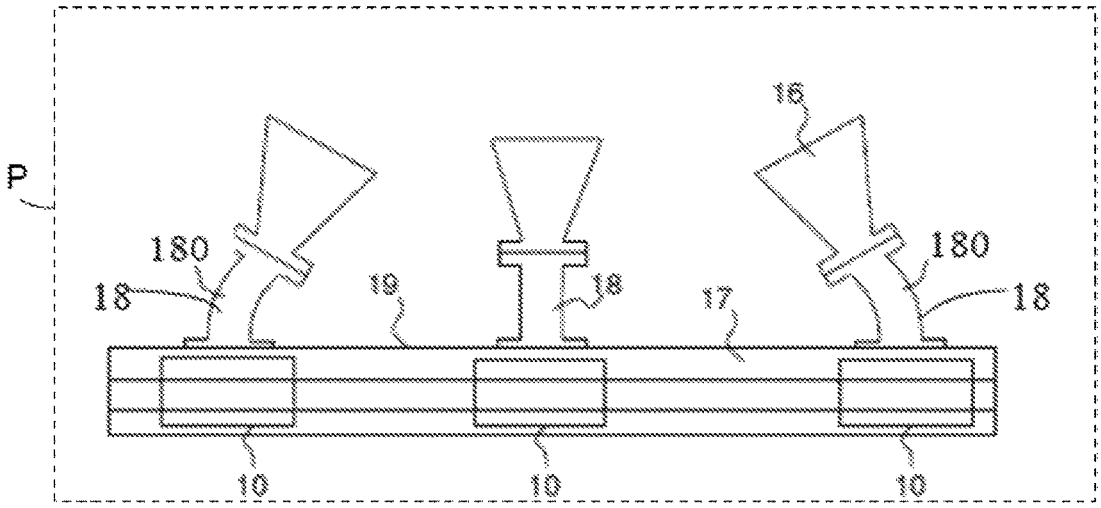
FIG. 2: a transverse cross-sectional diagram of an exemplary structural antenna module incorporating elementary radiating feeds with individual orientation, according to the invention.
Figure 3:
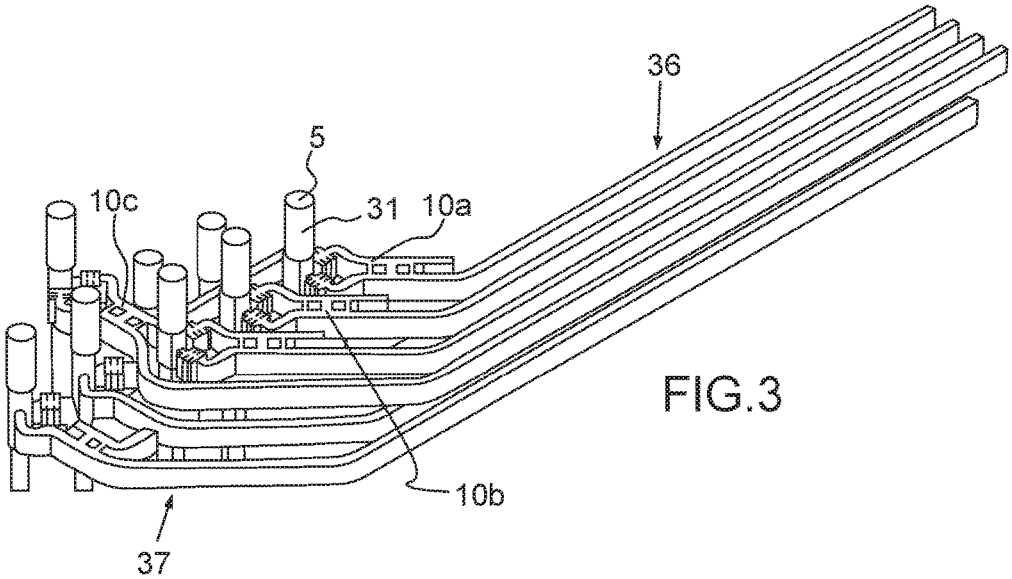
FIG. 3: a diagram illustrating an example of a number of RF systems mounted parallel to one another on two levels, according to the invention.

FIG. 2 illustrates an exemplary structural antenna module incorporating elementary radiating feeds with individual orientation, according to the invention, and FIG. 3 illustrates an exemplary arrangement of a number of mutually parallel RF systems. Each radiating feed comprises a radiofrequency RF system 10 comprising a main waveguide 31, visible in FIG. 3, and a feed horn 16 coupled to the main waveguide 31. According to the invention, each radiating feed further comprises a bent orientation ring 18 linked to a terminal end 5 of the main waveguide 31 of the corresponding RF system 10 and coupled to the feed horn 16, the bent orientation ring being intended to orient the feed horn in a desired direction, different from the direction of orientation of the main waveguide 31 of the RF system. Each orientation ring 18 comprises a bend 180 having an aperture angle whose value is defined individually as a function of the individual orientation desired for the associated feed horn. The orientation of each ring is produced by the dedicated orientation ring 18 by individually adjusting, for each horn, the aperture angle of the bend of the corresponding orientation ring. The RF systems can be respectively mounted in cavities of a support plate 17 common to all the radiating feeds or completely incorporated in the support plate as represented in FIG. 2. Advantageously, the orientation ring associated with a horn can be fixed onto a front face 19 of the support plate 17 or can be housed in a dedicated aperture of the front face 19 of the support plate 17. In the case where the orientation ring associated with a horn is fixed onto the front face 19 of the support plate 17, the terminal end 5 of the main waveguide 31 of the corresponding RF system is housed in a dedicated aperture formed in the front face of the support plate 17 so as to be able to ensure the continuity of the link between the main waveguide 31 and the orientation ring 18. The bent orientation ring makes it possible to dispense with all the flexible cables and makes it possible to pool the assembly of all the RF systems in a single common support. The RF systems can then be formed under the common support or be machined in the common support parallel to one another as represented for example in FIG. 3 in which the common support has been omitted and in which the RF systems 10*a*, 10*b*, 10*c* comprise two different levels 36, 37 for a bifrequency operation.

Figure 4:
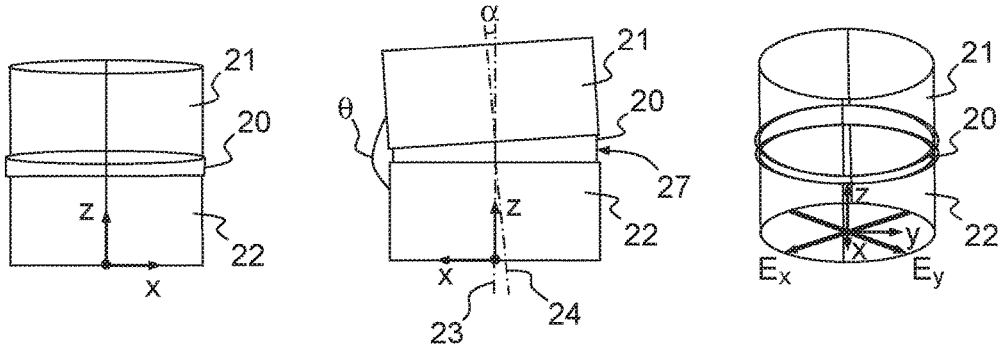
FIG. 4: three diagrams respectively illustrating, according to two different planes and according to a transparency view, a first exemplary bent orientation ring, according to the invention.

As represented in the example of FIG. 4, each bent orientation ring can consist of three parts secured together, the three parts consisting of two access waveguides 21, 22, intended to be linked respectively to a feed horn and to an RF system, and a matching waveguide section 20 located between the two access waveguides 21, 22 and forming a coupling iris between the two access waveguides. The two access waveguides 21, 22 can for example be of circular or square section. The access waveguide 22 can be linked to the feed horn and the access waveguide 21 can be linked to the main waveguide 31 of the RF system, the two access waveguides having respective axes oriented in different directions. The two access waveguides 21, 22 and the matching waveguide section 20 form a bent assembly, the bend having a vertex 27 situated on the matching waveguide section 20 and an aperture angle $\Theta$ whose value is predefined individually for each horn so as to tilt the axis 23 of the access waveguide 22 linked to the horn relative to the axis 24 of the access waveguide 21 linked to the RF system in the desired direction. This makes it possible to orient the feed horn relative to the support plate 17 and therefore to orient the direction of radiation of the horn, this direction of radiation corresponding to the axis 23. The tilt angle $\alpha$ of the axis 23 relative to the axis 24 lies between zero and a few degrees, its value being defined as a function of the positioning of the horn on the support plate and therefore as a function of its positioning relative to the focal point of the radiating array of an antenna provided with a reflector. The aperture angle $\Theta$ of the bend depends on the position $\Delta(x,y)$ of the radiating feed in the array and the equivalent focal distance Fe of the antenna, according to the following relationship:

$$\Theta = \arctan(\Delta(x,y)/Fe)$$

Each bent orientation ring therefore makes it possible to orient a feed horn relative to the support plate and therefore to correctly orient said feed horn relative to a reflector of a multibeam antenna. The bent orientation ring can be produced by the machining of the waveguides 21, 22, 20 in the mass in the form of two complementary half-shells which are assembled by any known technique to reconstitute the complete waveguides.

Figure 5:
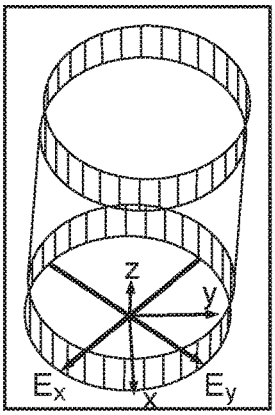
FIG. 5: a diagram illustrating, according to a transparency view, a second exemplary bent orientation ring, according to the invention.

Alternatively, as represented in FIG. 5, the bent orientation ring can be produced in a single piece in a one-piece part for example by using a 3D printer. In this case, the bent orientation ring is a piece of flexible strand, for example a cylinder or a flexible pipe, which makes it possible to achieve greater horn tilt angles.

Figure 6A:
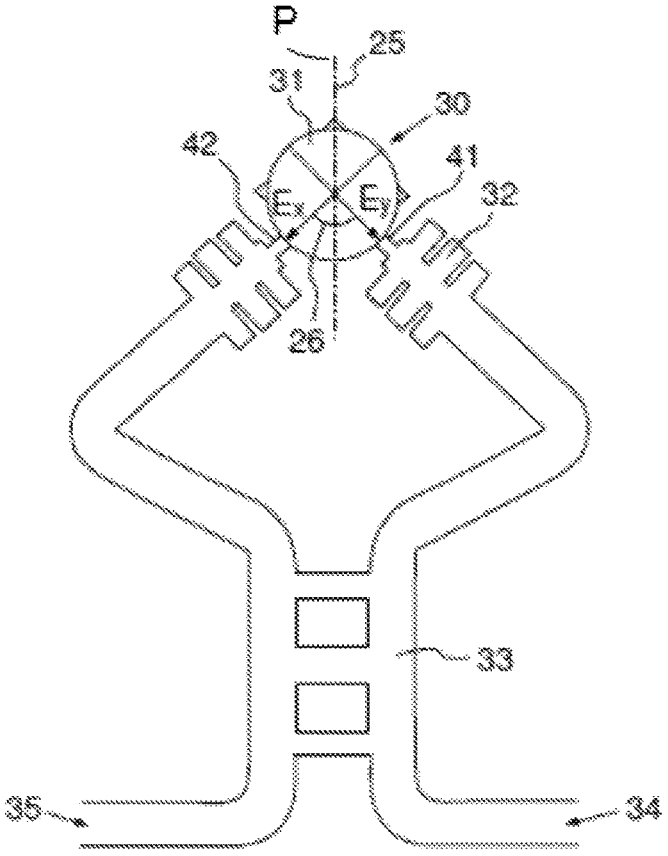
FIG. 6*a*: a transverse cross-sectional diagram illustrating the internal structure of a first exemplary planar RF system, according to the invention.
Figure 6B:
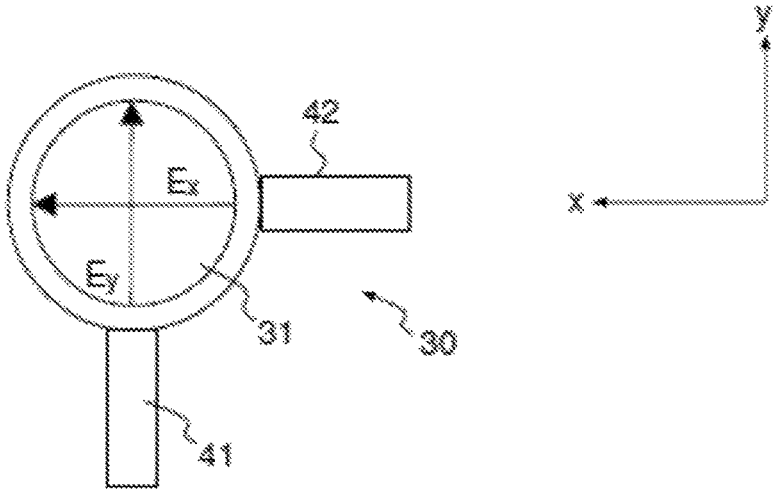
FIG. 6*b*: a transverse cross-sectional diagram illustrating an exemplary dissymmetrical OMT, according to the invention.

FIG. 6*a* illustrates a transverse cross-sectional diagram of an exemplary planar RF system operating in a single frequency band, according to the invention. The RF system, produced in waveguide technology, comprises a main waveguide 31 having a longitudinal axis arranged at right angles to the plane XY, an orthomodal transducer OMT 30, radiofrequency components of coupler 33 and filter 32 type operating in bipolarization mode and input/output ports 34, 35 respectively dedicated to the two polarizations. The input/output ports can have linear or circular polarization. The OMT can be symmetrical and comprise four transverse branches or, alternatively, be dissymmetrical and comprise two mutually orthogonal transverse branches. In the example of FIG. 6*a*, the OMT comprises an axial excitation input coupled to the main waveguide 31 and two mutually orthogonal transverse branches 41, 42, situated in the plane XY and coupled at right angles to the main waveguide 31 by two coupling slots that are not represented. The two coupling slots are formed in the wall of the main waveguide 31 and are spaced apart angularly by an angle 26 equal to 90°. The transverse branches of the OMT are linked to the radiofrequency components 32, 33. The main waveguide 31 comprises a top end intended to be connected to a feed horn 16 via the bent ring 18. The RF components, of coupler 33 and filter 32 type, are dedicated to the processing of the RF signals corresponding to a same frequency band. The OMT supplies the horn (in transmission), or is supplied by the horn (in reception), selectively either with a first electromagnetic mode exhibiting a first linear polarization, or with a second electromagnetic mode exhibiting a second linear polarization orthogonal to the first. The first and second polarizations have associated with them two electrical field components Ex, Ey whose orientation is imposed by the orientation of the RF systems situated in the plane XY and therefore by the position of the two coupling slots. The orientation of the field Ex is parallel to the waveguide of the transverse branch 42, the orientation of the field Ey is parallel to the waveguide of the transverse branch 41.

Figure 7A:
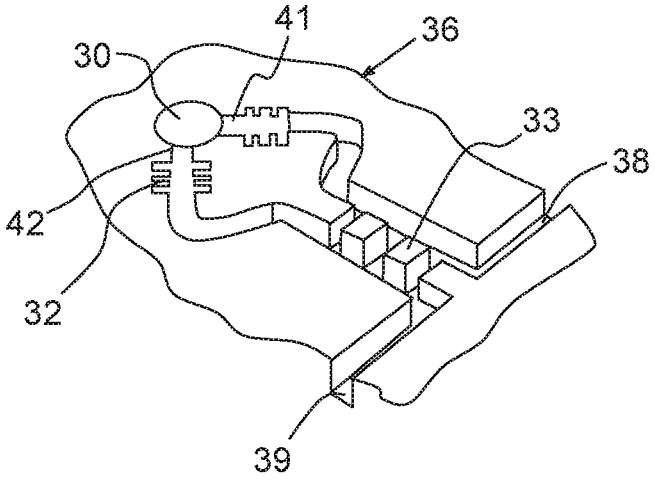
FIGS. 7*a* and 7*b*: two views illustrating the internal structure of the upper level, respectively of the lower level, of two stacked RF systems, according to the invention.
Figure 7B:
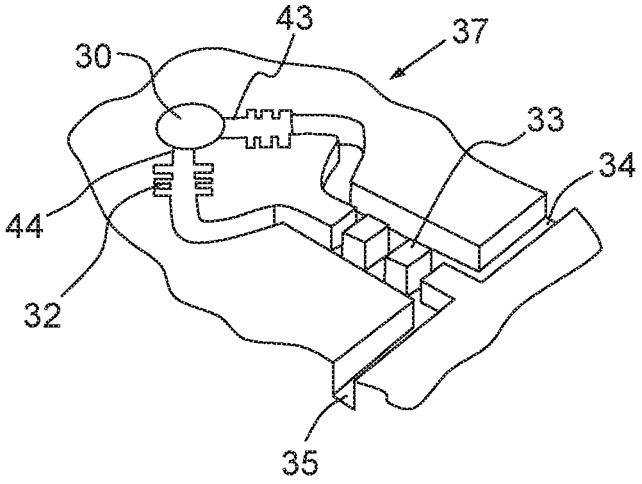

FIGS. 7*a* and 7*b* illustrate two views of an example of two stacked planar RF systems allowing operation in two different frequency bands, according to the invention. For operation in a number of different frequency bands, for example two frequency bands respectively dedicated to transmission and to reception, it is possible to stack a number of different RF systems, respectively dedicated to each frequency band, in different planar layers. In this case, the structure of the RF system of each radiating feed therefore comprises at least two different levels, respectively upper 36 and lower 37, stacked one on top of the other and respectively dedicated to the reception frequency band and to the transmission frequency band of the radiofrequency signals. Each radiofrequency level is arranged at right angles to the longitudinal axis of the main waveguide 31 of the RF system.

In FIGS. 7*a* and 7*b*, the OMT 30 coupled to the axial main waveguide 31 common to all the transmission and reception signals is the same as in FIG. 6*a* and comprises two transverse branches per level, but this is not essential, an OMT with four transverse branches can also be used. The upper transverse branches 41, 42 linked to the radiofrequency components of the upper RF level 36, can be dedicated to the reception of the RF signals and the two lower transverse branches 43, 44 linked to the radiofrequency components of the lower RF level 37 can be dedicated to the transmission of the RF signals. The axial main waveguide 31 is machined in the thickness of the two planar layers forming the upper and lower levels, and is coupled on the one hand to the upper transverse branches 41, 42 of the OMT by first axial coupling slots and on the other hand to the lower transverse branches 43, 44 of the OMT by second axial coupling slots. The first axial coupling slots are situated at a same first height in the wall of the axial waveguide and spaced apart angularly by an angle equal to 90° and respectively, the second axial coupling slots are situated at a same second height in the wall of the axial waveguide and spaced apart angularly by an angle equal to 90°. The first height corresponds to the upper level of the RF system and the second height corresponds to the lower level of the RF system. To reduce the bulk of the RF system, the first axial slots can be aligned above the second axial slots, but this is not essential, they can also be offset angularly relative to one another.

Advantageously, in the case where operation in a number of frequency bands is desired, it is sufficient to increase the number of levels of the RF system, each level being dedicated to one of the desired frequency bands.

Each RF system can for example be manufactured in two complementary parts, called half-shells, by a known machining method, the two metal half-shells then being assembled together by any type of link known, welding, bonding, screws. The radiofrequency components then consist of grooves machined in the two metal half-shells.

In the case of an application in the telecommunications field, the dissymmetry of the bent orientation ring has no impact on the performance levels of the radiating feeds because the excitation input main waveguide to which the feed horn is connected is dimensioned to allow the propagation of only a single propagation mode corresponding to the fundamental mode. Consequently, all the other modes, and in particular the modes with odd symmetry generated by the dissymmetry of the bent orientation ring can potentially be eliminated by traps placed at the input of the excitation assembly.

So as not to affect the radiating characteristics of the duly produced radiating feed, the bend of the orientation ring 18 must be placed in a plane of symmetry P of the RF system, with respect to the main field components Ex, Ey generated in the axial main waveguide 31 by the OMT. In effect, if the plane of symmetry is not observed, the bend will be seen as a different defect by the two transverse branches of the RF system and by the two coupling slots spaced apart angularly by 90°, which will cause the purity of the polarization to be degraded. The mounting of the orientation ring 18 relative to the RF system must therefore be done taking account of the orientation of the two orthogonal main fields Ex, Ey generated in the axial main waveguide 31 of the RF system. In relation to the two orthogonal main fields Ex, Ey, the plane of symmetry P is the plane containing the bisecting line of the angle formed by the directions of orientation of the two main fields Ex and Ey. The bend must therefore be positioned in this plane of symmetry P so as to be seen with the same phase by the two coupling slots of the planar RF system and for the radiofrequency discontinuity generated by the bend to have the same impact on the two field components of the fundamental mode. In the diagram of FIG. 6*a*, the only possible plane of symmetry P is the plane at right angles to the plane XY containing the bisecting line 25 of the angle formed by the two directions of the orthogonal field components Ex and Ey, that is to say of the angle separating the two coupling slots of the OMT, or even of the angle 26 formed by the two transverse branches 41, 42. The vertex 27 (visible in FIG. 4) of the bend of the orientation ring 18 is therefore placed in a plane orthogonal to the plane XY and containing the bisecting line 25 of the angle 26 separating the two orthogonal coupling slots, that is to say the angle 26 formed by the two transverse branches 41, 42. In the case of an OMT with four transverse branches, there are four coupling slots evenly spaced apart angularly. The bisecting line 25 then corresponds to that of the angle separating two consecutive orthogonal coupling slots, that is to say of the angle situated between two consecutive orthogonal transverse branches.

The RF system described in relation to FIGS. 6*a*, 7*a*, 7*b* has the advantage of having a completely planar, single-layer or multilayer, architecture, all the radiofrequency components corresponding to a same frequency band being manufactured by machining in the form of two metal half-shells stacked and assembled together. The manufacturing of all the radiofrequency components by machining gives the RF system a very great degree of robustness with respect to the performance level dispersions linked to the manufacturing of the components. In effect, all the components corresponding to a same frequency band being located in a same physical layer, all the electrical paths dedicated to the two polarizations of each RF system are symmetrical and therefore induce the same phase dispersion. Moreover, the milling, which is the only machining mode suited to the manufacturing of half-shells, makes it possible to guarantee excellent surface conditions and allows the deposition of a silver coating on the machined parts to allow for a reduction of the ohmic losses of approximately 30%.

In the case of operation in a number of different frequency bands, the multilayer structure of the RF system forms a very compact, very inexpensive, multiband bipolarization assembly which is compatible with layout in an array of radiating feeds with a reduced mesh size and which can be incorporated in a support plate common to a number of RF systems as shown in FIG. 2. The input/output ports 34, 35, 38, 39 of the RF system can be oriented on the sides, as in FIGS. 7*a*, 7*b*, or to the front or to the rear, depending on the needs.

Figure 8A:
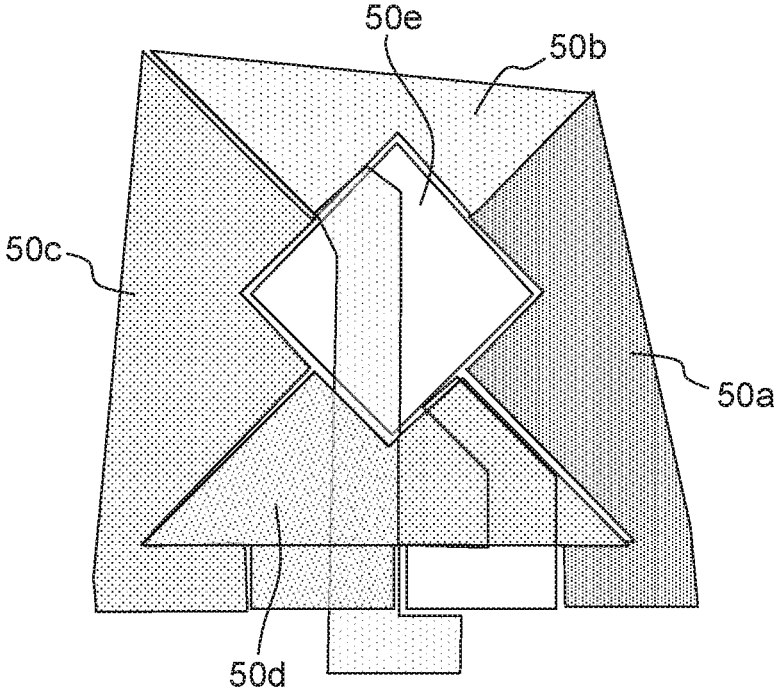
FIG. 8*a*: a plan view diagram, illustrating an exemplary radiating array sectorized into a number of independent radiating panels, according to the invention.
Figure 8B:
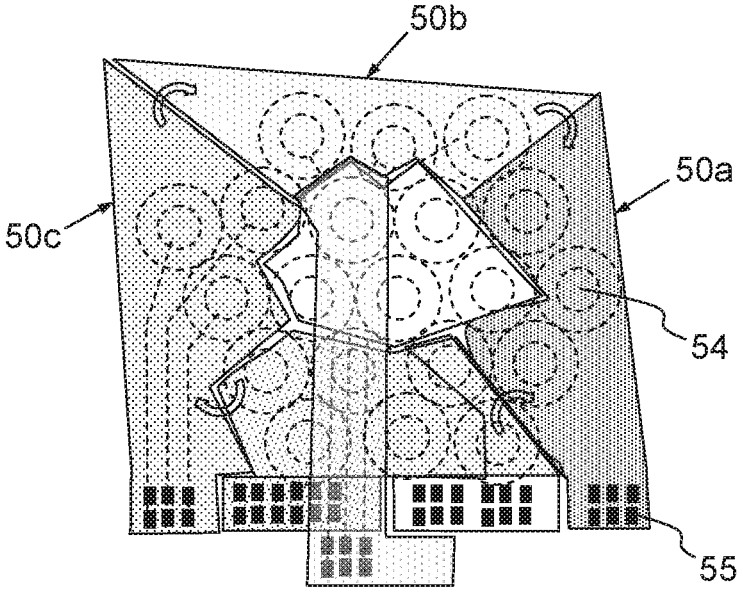
FIG. 8*b*: a diagram illustrating an exemplary layout of the radiating feeds and of the input and output ports on the radiating panels of FIG. 8*a*, according to the invention.

As represented in the examples of FIGS. 8*a* and 8*b*, this architecture also makes it possible to manufacture a sectorized radiating array as a number of independent radiating panels, 50*a*, 50*b*, 50*c*, 50*d*, 50*e*, each radiating panel consisting of a structural module incorporating a subset of a number of radiating feeds 54 comprising RF systems machined in a matrix in a support plate 51 common to all the feeds 54 of the subset, and independent of the support plates of the feeds of the other panels. The RF supply and output waveguides of the different radiating feeds incorporated in each panel 50*a* are then routed in the common support plate as far as the respective input and output ports 55 which can for example be grouped together at a same point of the corresponding panel. For example, all the input and output ports 55 can be aligned alongside one another, on an edge of the panel. In this case, the manufacturing of the RF systems incorporated in each panel can be pooled, the RF systems all being produced by machining in the form of three half-shells stacked and assembled together. This makes it possible to reduce the manufacturing costs and reduce the losses.

Figure 8C:
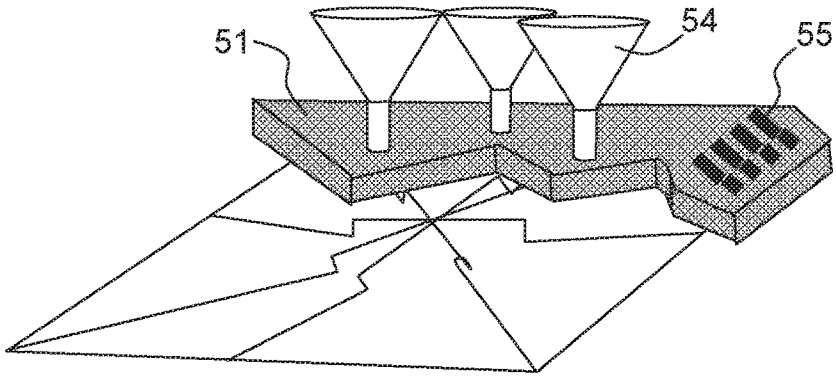
FIG. 8*c*: a diagram illustrating an exemplary cut of the support plates of each radiating panel of a sectorized radiating array, according to the invention.

The different radiating panels 50*a*, 50*b*, 50*c*, 50*d*, 50*e* are then assembled to one another to form the radiating array. To facilitate the assembly of the different panels together, the forms of the cuts of the different support plates corresponding to each panel complement one another so that they can be fitted into one another, as shown in FIG. 8*c*. Each panel of the radiating array can then be oriented independently of the other panels. The orientation of the RF systems incorporated in each panel is then ensured globally by the orientation of the corresponding panel, then refined individually for each radiating feed of the panel via the dedicated orientation ring which ensures the individual orientation of each feed horn corresponding to each radiating feed. The radiating array then forms a faceted assembly, each facet consisting of a radiating panel.

Figure 9:
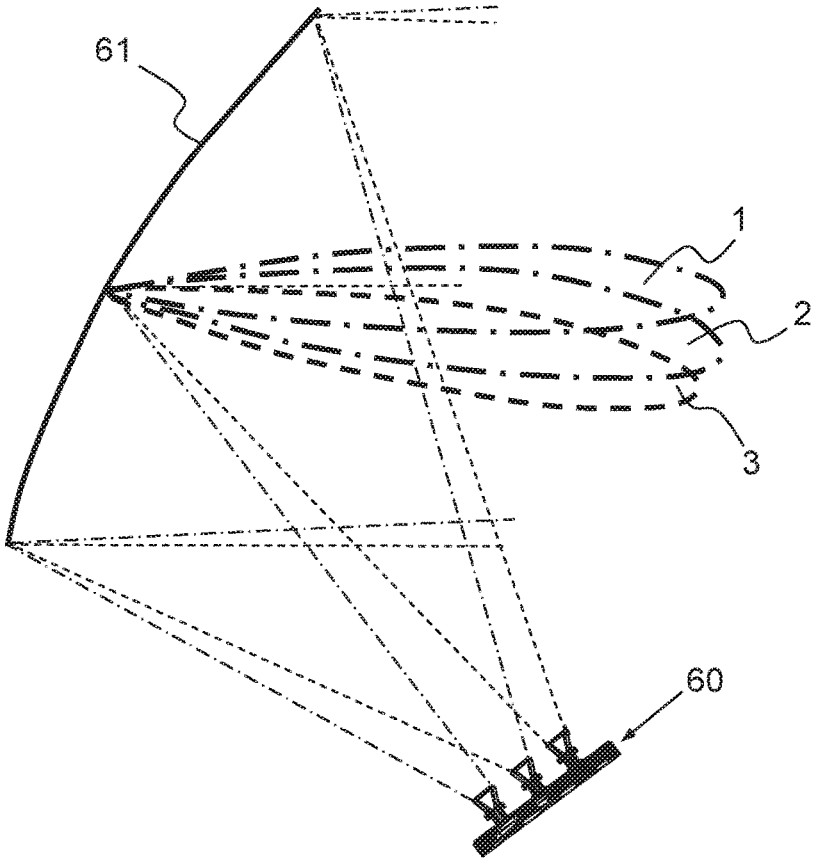
FIG. 9: an exemplary multibeam antenna, according to the invention.

An exemplary layout of a radiating array in a multibeam antenna is represented in FIG. 9. The radiating array comprises at least one structural module or at least one radiating panel, the radiating panel comprising a structural module incorporating radiating feeds. The radiating array 60 according to the invention is placed at the focus of a reflector 61 to create a number of different beams 1, 2, 3. Each radiating feed is oriented individually, via the dedicated orientation ring, according to its positioning in the radiating array relative to the reflector.

Although the invention has been described in relation to particular embodiments, it is obvious that it is in no way limited thereto and comprises all the technical equivalents of the means described and the combinations thereof provided the latter fall within the scope of the invention.

The invention claimed is:

1. A structural antenna module incorporating elementary radiating feeds, each radiating feed comprising a radiofrequency RF system linked to a feed horn, the RF system comprising a main waveguide having a longitudinal axis arranged at right angles to a plane (XY) and an orthomodal transducer OMT comprising two mutually orthogonal transverse branches, situated parallel to the plane (XY) and coupled at right angles to the main waveguide by respective coupling slots, wherein the feed horn is coupled to a terminal end of the main waveguide via a bent orientation ring to orient the feed horn in a desired direction different from the longitudinal axis of the main waveguide, the bend of the orientation ring being placed in a plane of symmetry of the RF system, the plane of symmetry being orthogonal to the plane (XY) and containing the bisecting line of an angle formed by the two transverse branches of the OMT.

2. The structural module according to claim 1, further comprising a support plate common to all the radiating feeds, the RF systems being completely incorporated in the support plate.

3. The structural module according to claim 2, wherein the orientation ring associated with each feed horn is housed in a dedicated aperture formed in a front face of the support plate.

4. The structural module according to claim 2, wherein the terminal end of the main waveguide of each RF system is housed in a dedicated aperture formed in a front face of the support plate and wherein the orientation ring associated with each feed horn is fixed onto a front face of the support plate, in the extension of the corresponding terminal end.

5. The structural module according to claim 1, wherein the orientation ring of each radiating feed consists of three parts secured together, the three parts consisting of two rigid access waveguides having different longitudinal axes which are respectively linked to a feed horn and to an RF system, and a matching waveguide section located between the two access waveguides, the matching waveguide section forming the bend of the orientation ring.

6. The structural module according to claim 1, wherein the orientation ring comprises a coupling iris.

7. A radiating panel comprising a structural module according to claim 1.

8. The radiating panel according to claim 7, wherein the radiating feeds are machined in a matrix in the common support plate and further comprise respective supply and output waveguides, routed in the common support plate and respectively linked to input and output ports grouped alongside one another on the radiating panel.

9. A radiating array comprising at least one radiating panel according to claim 8.

10. The radiating array according to claim 9, comprising a number of radiating panels that are oriented independently of one another.

11. A multibeam antenna comprising at least one radiating array according to claim 9.

* * * * *